US006636183B1

(12) United States Patent
Hellgren et al.

(10) Patent No.: US 6,636,183 B1
(45) Date of Patent: Oct. 21, 2003

(54) ANTENNA MEANS, A RADIO COMMUNICATION SYSTEM AND A METHOD FOR MANUFACTURING A RADIATING STRUCTURE

(75) Inventors: Mattias Hellgren, Täby (SE); Robert Graham, Isle of Wight (GB)

(73) Assignee: Smarteq Wireless AB, Enebyberg (CH)

( * ) Notice: Subject to any disclaimer, the term of this patent is extended or adjusted under 35 U.S.C. 154(b) by 0 days.

(21) Appl. No.: 09/926,390

(22) PCT Filed: Apr. 17, 2000

(86) PCT No.: PCT/SE00/00734

§ 371 (c)(1),
(2), (4) Date: Oct. 25, 2001

(87) PCT Pub. No.: WO00/65688

PCT Pub. Date: Nov. 2, 2000

(30) Foreign Application Priority Data

Apr. 26, 1999 (SE) ..... 9901492
Jan. 31, 2000 (SE) ..... 0000289

(51) Int. Cl.[7] ..... H01Q 13/10
(52) U.S. Cl. ..... 343/767; 343/711
(58) Field of Search ..... 343/767, 770, 343/771, 711, 713

(56) References Cited

U.S. PATENT DOCUMENTS 3,189,908 A 6/1965 Provencher ..... 343/771
3,312,976 A * 4/1967 Gregory ..... 343/770
3,445,852 A * 5/1969 Karlson ..... 343/767
3,530,479 A * 9/1970 Waldron ..... 343/767
4,873,528 A 10/1989 Girard ..... 343/770
5,177,494 A 1/1993 Dörrie et al. ..... 343/711
5,402,134 A 3/1995 Miller et al. ..... 343/742
5,629,712 A 5/1997 Adrian et al. ..... 343/713
5,682,168 A 10/1997 James et al. ..... 343/713
5,812,095 A 9/1998 Adrian et al. ..... 343/713
5,900,843 A * 5/1999 Lee ..... 343/767
6,127,983 A * 10/2000 Rivera et al. ..... 343/767
6,198,453 B1 * 3/2001 Chew ..... 343/771

FOREIGN PATENT DOCUMENTS

DE 3508929 10/1986 ..... H01Q/21/24
DE 8913811 2/1990 ..... H01Q/1/32
DE 4000381 7/1991 ..... H01Q/1/32
WO 93/03507 2/1993 ..... H01Q/1/32

* cited by examiner

*Primary Examiner*—Hoang Nguyen
(74) *Attorney, Agent, or Firm*—Jacobson Holman PLLC

(57) ABSTRACT

An antenna means for transmitting and/or receiving RF signals, a radio communication system and a method for manufacturing a radiating structure. The antenna means comprises a conductive structure (10) extending between first and second opposite edges (11, 12), and a feed portion. The conductive structure (10) is formed to a radiating structure (1) partially enclosing a volume, and the first and second edges (11, 12) are located at a distance from each other forming a radiating first slit (21), which has a first and a second open end. Hereby an antenna means, which can be made compact, and can operate in more than one frequency band is obtained. A second slit can be arranged to improve the operation in a higher frequency band. The radio communication system comprises transmitting/receiving circuits connected to an such antenna means.

30 Claims, 8 Drawing Sheets

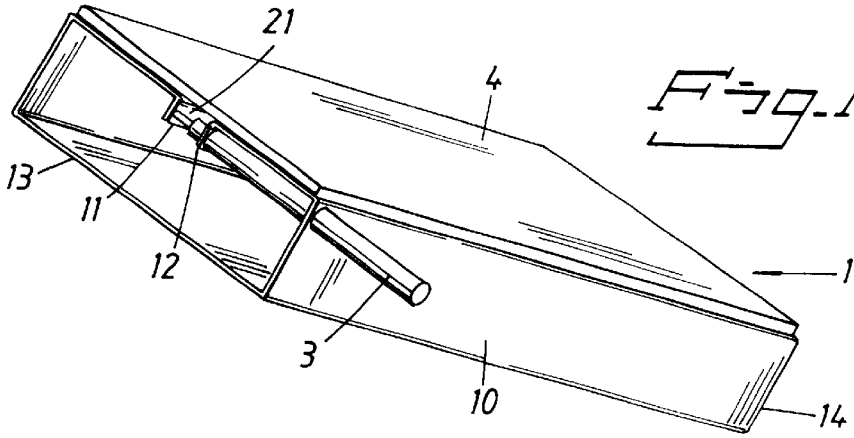
Fig. 11
Fig. 12
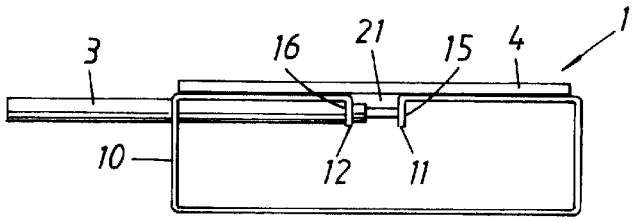
Fig. 13
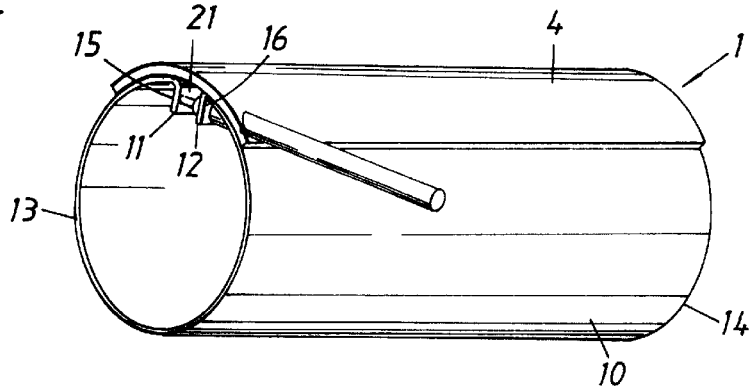
Fig. 14
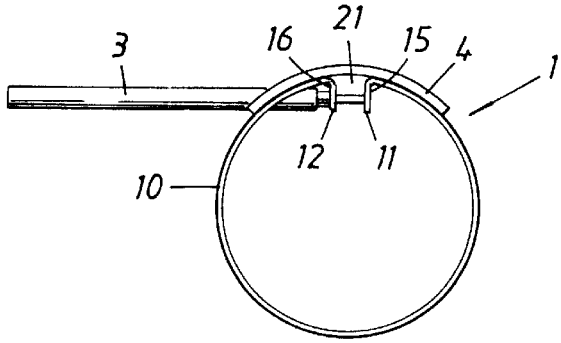

Fig. 15
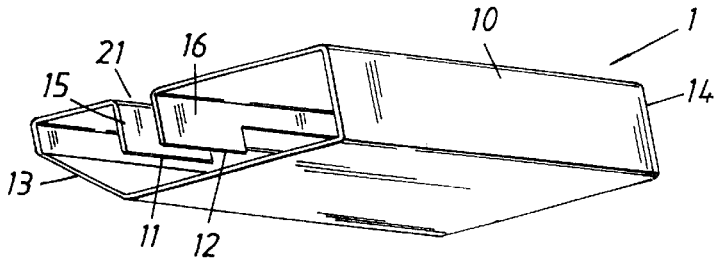
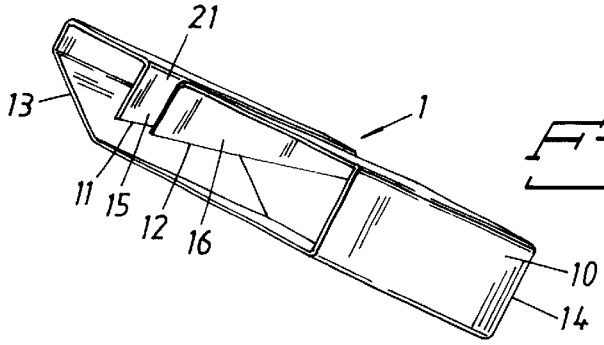
Fig. 16
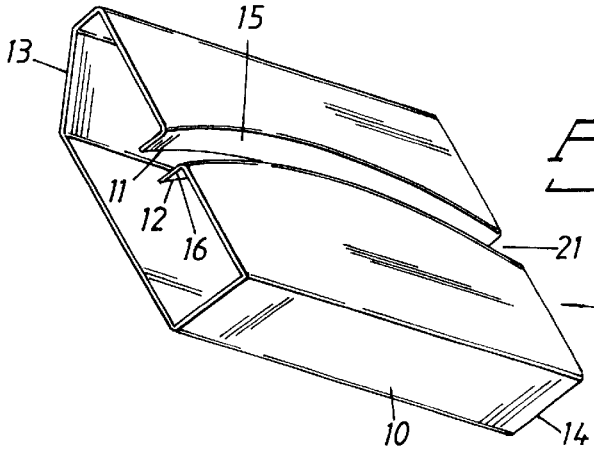
Fig. 17
Fig. 18
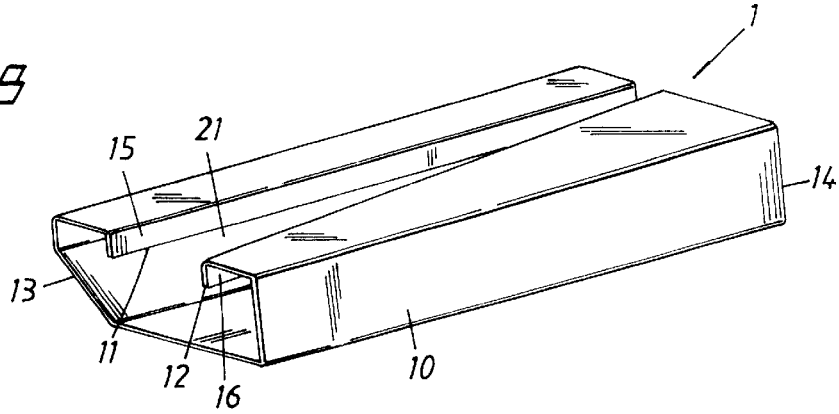

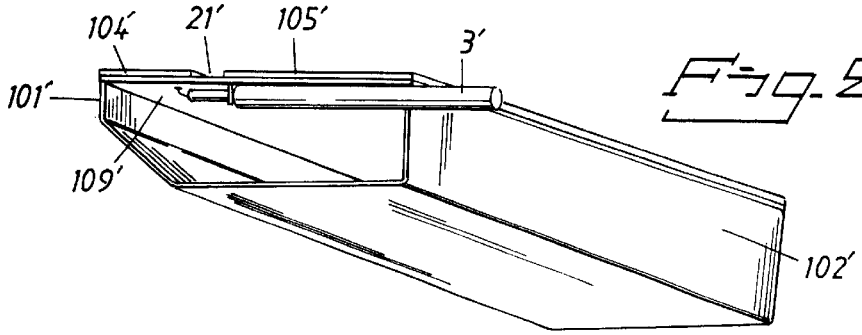
Fig. 22
Fig. 23
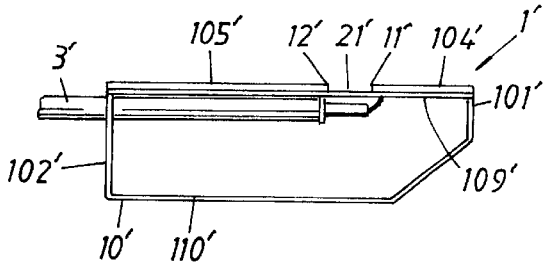
Fig. 21
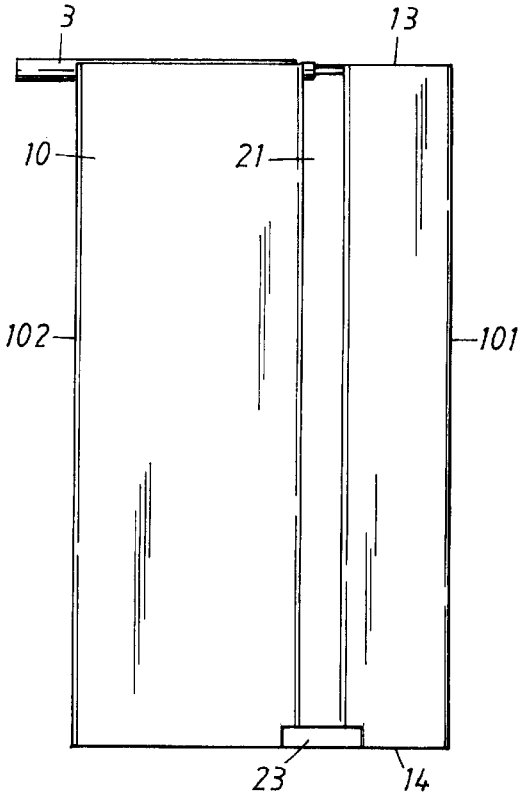
Fig. 24
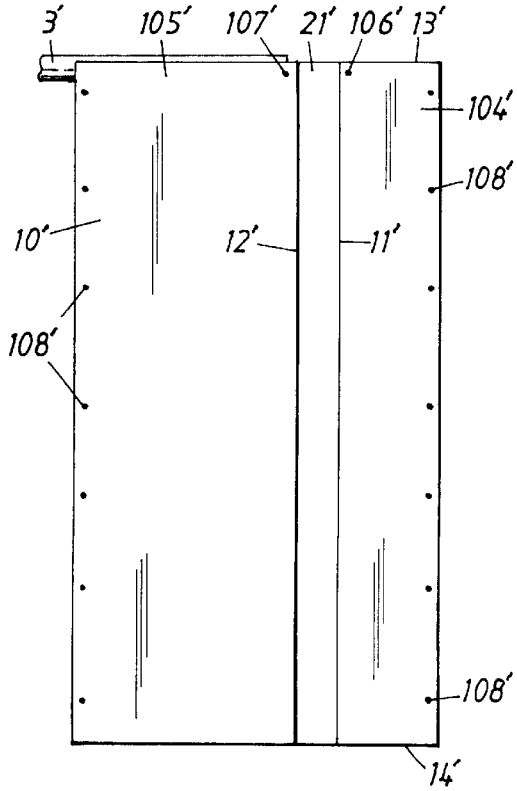

ANTENNA MEANS, A RADIO COMMUNICATION SYSTEM AND A METHOD FOR MANUFACTURING A RADIATING STRUCTURE

This is a nationalization of PCT/SE00/00734 filed Apr. 17, 2000 and published in English.

FIELD AND BACKGROUND OF THE INVENTION

The invention relates to an antenna means for transmitting and/or receiving RF signals, comprising a conductive structure extending between first and second opposite edges and a feed portion. Specifically, it relates to an antenna means for a mobile radio communication device, and is especially suitable as a vehicle antenna. It also relates to a radio communication system including such an antenna means and to a method for manufacturing a radiating structure included in the antenna means.

BACKGROUND OF THE INVENTION AND RELATED ART

Many vehicles are equipped with antennas protruding from the vehicle body. Such antennas are for example whip, wire or blade antennas. To overcome problems with elements protruding from the vehicle body, there is a demand for antennas concealed or arranged in the vehicle.

U.S. Pat. No. 5,682,168 discloses an example of such antennas, where a dipole antenna is submerged beneath a cover over a roof supporting member of a motor vehicle or hidden behind or as a part of the front grill. In U.S. Pat. No. 5,402,134 a planar antenna for installation under a dielectric cover of a vehicle is disclosed. Antennas concealed in a piece such as a spoiler rack are disclosed in U.S. Pat. No. 5,629,712 and U.S. Pat. No. 5,812,095. Those antennas are complicated to manufacture and to mount. Further, operation in more than one frequency band requires special arrangements. They are also dependent of a ground plane or sensitive to conductive parts in the vicinity.

Further, U.S. Pat. No. 5,177,494 discloses a vehicular slot antenna system, in which a plurality of slot antenna units are installed on the vehicle. Each antenna unit is U-shaped and is provided with a closed opening or slot. Such an antenna unit is intended for operation in one frequency band only. Further, an antenna unit of this kind radiates from both sides of a plane of the plate portion in which the slot is arranged.

SUMMARY OF THE INVENTION

The main objects of the invention are to provide an antenna means for transmitting and/or receiving RF signals, which antenna means can be manufactured in a simple and cost-effective way, is simple to mount and requires a relatively small space.

Another object of the invention is to provide an antenna means, which, does not require a separate ground plane and can be mounted to have relatively low sensitivity to adjacent conductive parts.

These and other objects are attained by an antenna means.

By the features of an antenna means, which can operate in more than one frequency band, is achieved.

By the features of an antenna means having good antenna performance and directional radiation characteristics is further achieved. The arrangement of the radiating structure as a closed structure has the effect that a main portion of the radiation is directed from the slit portion in a lobe away from the radiating structure. Mounted in a vehicle with the slit facing a glass pane, thus a major portion of the radiation will exit through the window in directions from the vehicle.

The antenna means does not require a separate ground plane and can be mounted to have relatively low sensitivity to adjacent conductive parts, is very suitable for mounting a vehicle with the slit covered by a glass pane, and the radiating structure adjacent to, or far from conductive parts.

By providing the slit with open ends the operation in plural bands is remarkably improved, and surprisingly it also makes it possible to decrease the dimensions of the antenna means without significant decrease in antenna performance.

By the features of an antenna means which is simple to match, and in which the matching can be done directly in the radiating structure, is also achieved.

By the arrangement of a capacitance between the edges of a slit, the electrical lengths in the radiating structure are increased, and therefore the dimensions of the antenna means can be reduced.

By forming the capacitance by portions of the conductive structure, a well defined capacitance, which can be formed in a simple and efficient way is achieved.

By the arrangement of a second slit, the antenna characteristics in a higher frequency band can be further improved.

By the arrangement of a dielectric material covering the slit, the electrical lengths in the radiating structure are increased, and therefore the dimensions of the antenna means can be reduced.

By further arranging the antenna means having a dielectric material covering the slit to be covered by a second dielectric material having different dielectric constant, such as a window, the electromagnetic waves transmitted/received by the antenna means can be refracted and the antenna lobe can hereby be controlled.

By including a conductive layer carried by a dielectric substrate or carrier in the conductive or radiating structure, an antenna device is obtained, which is simple to manufacture with simple, suitable and accurate methods for obtaining the slit.

By dividing the conductive or-radiating structure into at least two constructional portions, whereof one portion includes a conductive layer carried by a dielectric substrate or carrier, an antenna device is obtained, which is simple to manufacture and to adapt to different frequency bands and operation conditions.

BRIEF DESCRIPTION OF THE DRAWINGS

FIG. 11 is a view of an antenna means according to a fifth embodiment of the invention.

FIG. 12 is a side view of the antenna means of FIG. 11.

FIG. 13 is a view of an antenna means according to a sixth embodiment of the invention.

FIG. 14 is a side view of the antenna means of FIG. 13.

FIGS. 15 and 16 show the radiating structure with different shapes of the sections forming the capacitance over the slit.

FIGS. 17 and 18 show the radiating structure with different shapes of the slit.

FIG. 21 shows an antenna device according to the invention provided with a slit, which is short circuited in one end.

FIG. 22 is a view of a variation of an antenna means according to the invention, where a conductive layer, carried by a substrate or carrier, is included in the conductive or radiating structure.

FIG. 23 is a side view of the antenna means of FIG. 22.

FIG. 24 is a top view of the antenna means of FIG. 22.

DESCRIPTION OF PREFERRED EMBODIMENTS

Figure 1:
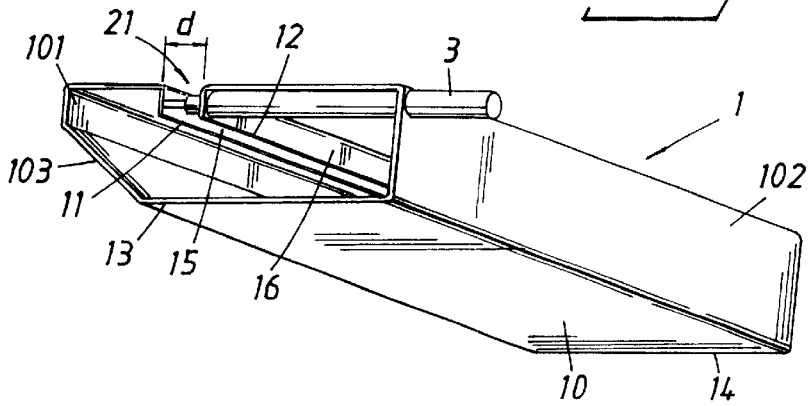
FIG. 1 is a view of an antenna means according to a first embodiment of the invention.

It should be noted that similar or corresponding parts have been given the same reference numerals throughout the drawings.

Figure 2:
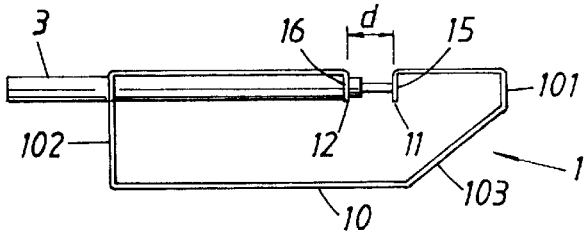
FIG. 2 is a side view of the antenna means of FIG. 1.
Figure 3:
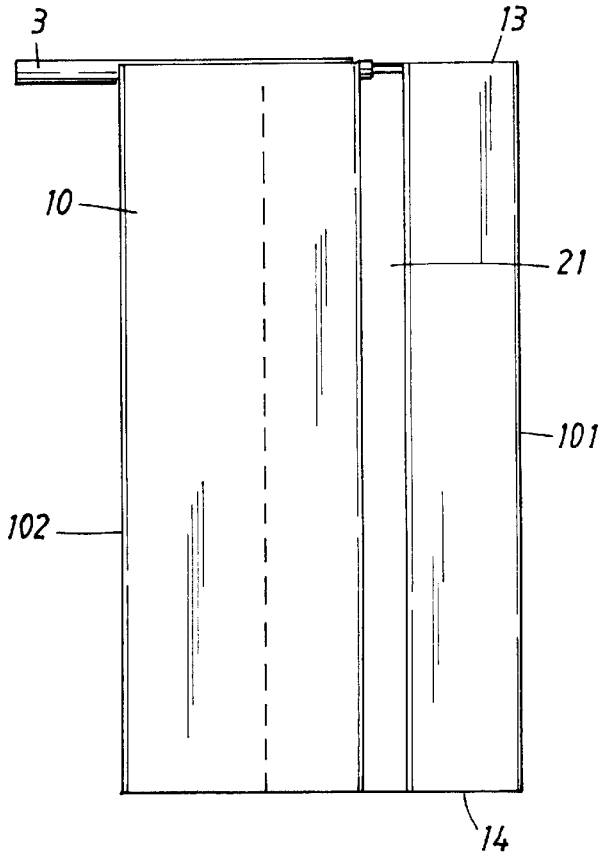
FIG. 3 is a top view of the antenna means of FIG. 1.

With reference to FIGS. 1, 2 and 3, an antenna means for transmitting and/or receiving RF signals according to a first embodiment of the invention is shown in different views. A radiating structure 1 is formed of a conductive structure in the form of a conductive plate 10, which has curved portions so as to form a structure partially enclosing a dielectric is volume, such as air. The plate 10 has first and second edges 11, 12, and the structure is formed so that the edges are essentially parallel. The edges are separated by a distance d, so as to form a radiating slit 21.

Further, the plate has third and fourth edges 13, 14 which are curved and limit the radiating structure in a longitudinal direction. As seen, the radiating structure 1 is open at the ends defined by the third and fourth edges 13, 14, and the slit 21 has open ends in the regions of the third and fourth edges 13, 14. Sideways, the radiating structure 1 is limited by a first 101 and a second 102 wall section. The radiating structure 1 has in this embodiment the form of a profile with constant cross section. The wall section 103 is inclined in order to adapt the radiating structure 1 to an available space. The radiating structure 1 can alternatively have a rectangular or other cross section and can easily be adapted to an available space.

The portions of the plate surrounding the slit 21 are preferably arranged in the same plane and the portions adjacent to the first and second edges 11, 12 are preferably folded down to form two essentially parallel sections 15, 16. Between these sections a capacitance is formed. The folded down sections could be omitted so that the edges 11, 12 face each other and are located in the same plane the portions of the plate surrounding the slit 21. In such a case-capacitances can be arranged by other means or left out.

The radiating structure 1 is fed by a feeding line 3, e.g. by a coaxial cable as shown in the figure. The feed line can however be of any other suitable kind, e.g. a part of a pattern of a printed circuit board. The ground conductor of the feed line 3 is connected to the plate 10 at or close to the section 16 and close to the edge 13. The signal conductor (hot wire) of the feed line 3 is connected to the plate 10 on the other side of the slit 21 at or close to the section 15 and close to the edge 13. Even if it is preferred that the feed line is connected at the edge 13 or close thereto, it can be connected at a distance therefrom, e.g. up to about 20 mm (for radio telephone communication bands). The feeding line 3 can for example enter into the radiating structure 1 through a hole in a wall portion of the conductive structure or plate 10, as shown, or enter from an open side of the structure. It can of course enter the radiating structure 1 from the opposite side to the shown, and then the hot wire is to be connected to the section 16, and ground is connected to section 15, or in the vicinity thereof, as mentioned above. If the sections 15 and 16 are omitted the connection points or feed portions will be located on the plate 10 in portions adjacent to the locations described above.

In order to obtain good performance the distance between the third and fourth edges 13, 14 should generally be approximately $\lambda/2$, where $\lambda$ is the wavelength of signals of the center frequency $f_{c1}$ of the (first) frequency band, in which the antenna means is to transmit/receive. If the antenna operates in more than one frequency band, $\lambda$ is the wavelength of signals of the center frequency of the lower frequency band. Moreover, the circumference of the radiating structure 1 (the slit excluded) in a direction perpendicular to the slit 21 should preferably also be approximately $\lambda/2$. The radiating structure is thus resonant for the frequency $f_{c1}$. However, by the arrangement of the slit with open ends and the possible arrangement of the capacitance(s), the electrical lengths in the radiating structure 1 are increased. Therefore, the physical lengths can be decreased to the same extent. However it has been shown that good antenna performance of the antenna means according to the invention can still be obtained if the dimensions are further decreased. Especially, the length l of the slit (distance between edges 13 and 14) can be decreased to approximately $\lambda/3$ without significant decrease in performance.

As an example, the slit has a width (between the edges 11, 12) being about 5–7 mm, for operation in radio telephone communication bands (approximately in the range 0.8–2.2 MHz). The width of the sections 15, 16 forming the capacitance is preferably also in the range 5–7 mm for the same frequency bands.

Figure 4:
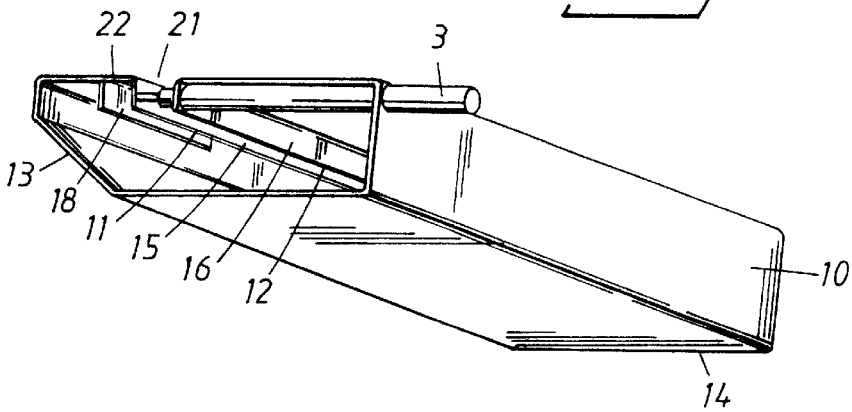
FIG. 4 is a view of an antenna means according to a second embodiment of the invention.
Figure 5:
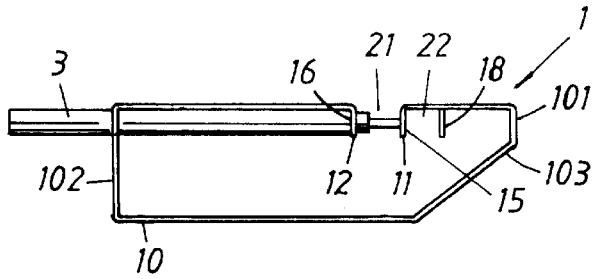
FIG. 5 is a side view of the antenna means of FIG. 4.
Figure 6:
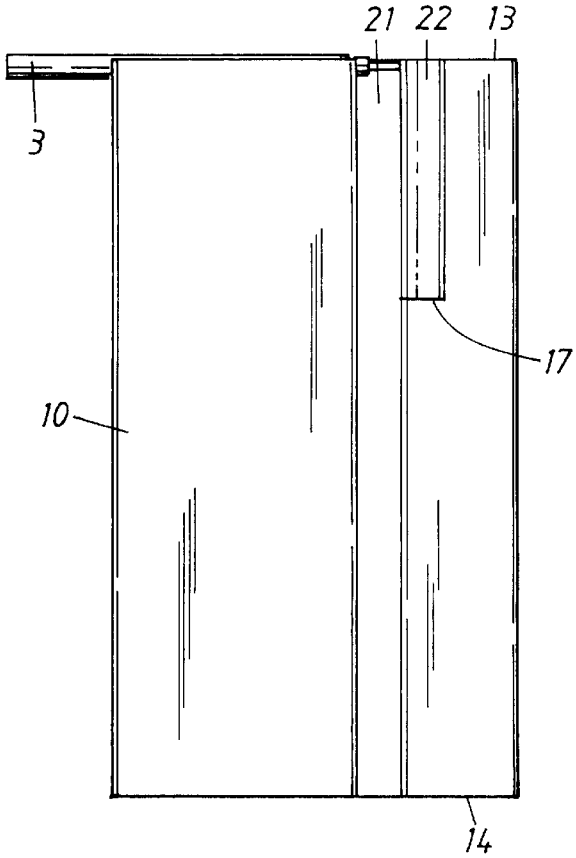
FIG. 6 is a top view of the antenna means of FIG. 4.

FIGS. 4, 5 and 6 show an antenna means for transmitting and/or receiving RF signals according to a second embodiment of the invention in different views. This embodiment is very similar to the first embodiment. However, a second slit 22 has been arranged essentially parallel with the first slit 21, in order to obtain improved operation in the second (higher) frequency band, having the center frequency $f_2$. The second slit 22 has an open end surrounded by the third edge 13, and continues towards the fourth edge 14 up to its closed second end 17, which preferably is located at a distance in the range $\lambda/2$–$\lambda/3$ from the open end, where $\lambda$ is the wavelength for signals of the frequency $f_2$. A section 18 of the plate can be folded down to be parallel with the sections 15 and 16 to form a second capacitance together with section 15. The capacitance can however be left out, as in the first embodiment. Even in this embodiment it is preferred that the signal conductor (hot wire) of the feed line 3 is connected to the plate 10 at or close to the section 15 and close to the edge 13, although other connection points can be possible, as mentioned above.

By the arrangement of the second slit 22, the operation of the antenna means in a second frequency band having a center frequency $f_{c2}$ is improved, when $f_{c1}<f_{c2}$. The improvement is a result of that the second slit assists in directing the radiation of the higher frequency band. With the second slit 22 improved antenna operation can be obtained in for example the 900 MHz and 1800 MHz bands.

Figure 7:
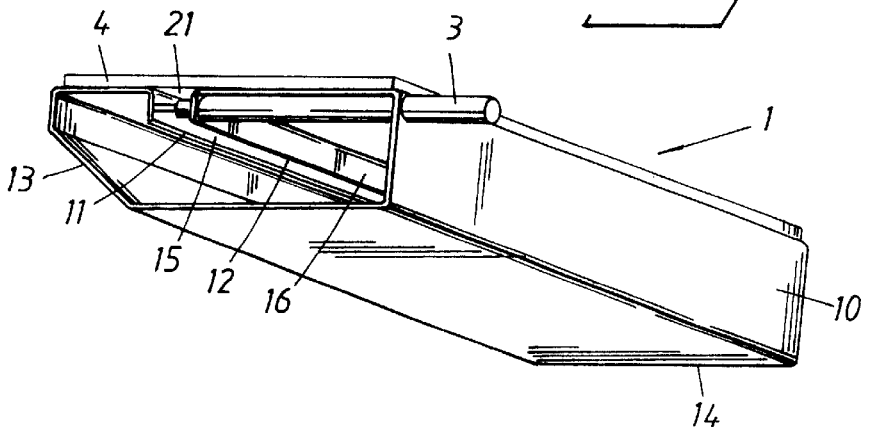
FIG. 7 is a view of an antenna means according to a third embodiment of the invention.
Figure 8:
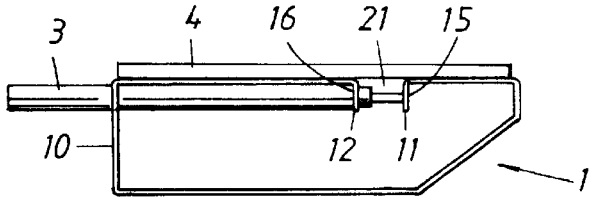
FIG. 8 is a side view of the antenna means of FIG. 7.

In the FIGS. 7 and 8, an antenna means for transmitting and/or receiving RF signals according to a third embodiment of the invention is shown in different views. This embodiment is also very similar to the first embodiment. However, a dielectric plate 4 is arranged on, and in contact with plate 10 on the side where the slit is located. The plate covers the whole side, but could be smaller so as to cover at least the slit. The arrangement of the dielectric plate has the effect that the electrical lengths in the radiating structure are increased. Hereby the dimensions of the radiating structure 1 can be decreased.

Figure 9:
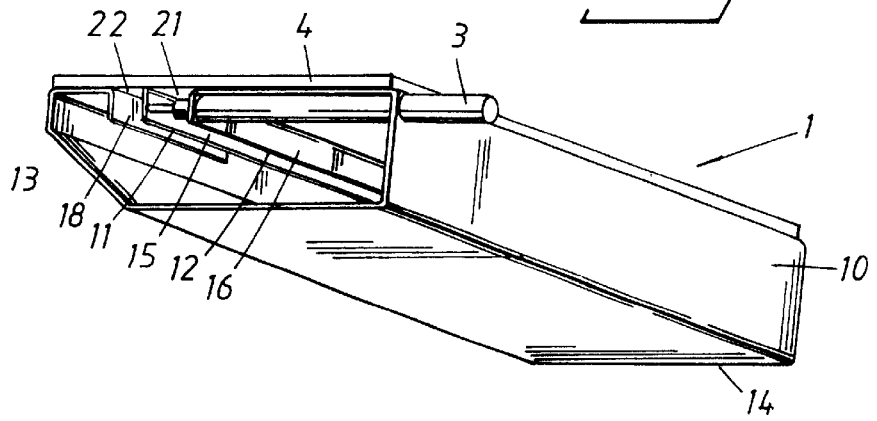
FIG. 9 is a view of an antenna means according to a fourth embodiment of the invention.
Figure 10:
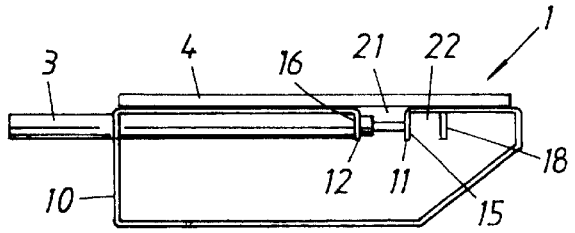
FIG. 10 is a side view of the antenna means of FIG. 9.

FIGS. 9 and 10, show an antenna means for transmitting and/or receiving RF signals according to a fourth embodiment of the invention in different views. In this embodiment a dielectric plate 4 is arranged in the same way as in the third embodiment but on a radiating structure 1 as described in connection to the second embodiment, i.e. with two slits 21, 22.

A fifth embodiment of an antenna means for transmitting and/or receiving RF signals according to the invention is shown in FIGS. 11 and 12 in different views. This embodiment is similar to the third embodiment, but differs from that in that the radiating structure 1 has a different cross section in a plane perpendicular to the slit 21. Alternatively to what is shown, the radiating structure 1 can have two slits and/or have the dielectric plate 4 left out.

FIGS. 13 and 14 shows in different views an antenna means for transmitting and/or receiving RF signals according to a sixth embodiment of the invention. This embodiment is similar to the third embodiment, but differs from that in that the radiating structure 1 has a circular cross section in a plane perpendicular to the slit 21, and that the dielectric plate has the shape of a portion of a tube. Alternatively to what is shown, the radiating structure 1 can have two slits and/or have the dielectric plate 4 left out.

Even if a major portion of the electromagnetic radiation is transmitted/received from/in the slit, the whole radiating structure 1 takes part in the transmission/reception, in embodiments of the invention. The antenna means can be seen as including two radiation sources in the same structure. One radiates as an electric dipole across the slit, due to the electric field over the slit and the proximity to the first 101 and second 102 wall sections. The other radiates as a magnetic dipole, due to the currents in the plate. In a cross section Perpendicular to the extension of the slit the plate can be seen as a current loop radiating as a magnetic dipole with its dipole axis perpendicular to and through the center of the loop, due to the currents circulating in the radiating structure 1. The electric field radiating from the magnetic dipole co-operates with the radiation from the slit directed out from the structure, and counteracts the radiation from the slit directed in to the structure. The operation in reception is the reverse to that of transmission, by the law of reciprocity.

In the open slit arrangement the voltage over the slit is constant along its extension between the free ends. Due to this fact, the length l of the slit can be decreased to a great extent without significant decrease in antenna performance. In a slot with closed ends the voltage over the slot varies along its extension between the closed ends, where it is zero at the ends and has a maximum in the center between the ends. This implies that a slit (with open ends) can be made substantially shorter than a slot having closed ends, for equal radiation properties.

A variation of an antenna means according to the invention, is shown in FIGS. 22, 23 and 24. Here a conductive layer 104', 105', carried by a substrate or carrier 109', is included in the conductive or radiating structure 10', 1'.

The antenna means is divided into two constructional portions, whereof one, the bottom portion 110' in the figures, is a conductive portion having a generally U-shaped cross section. Portion 110' can be made from a plate, which is bent or by extruding the suitable profile. Alternatively it could be made in any suitable way to obtain a conductive structure, e.g. as a conductive layer on a dielectric carrier or flexfilm.

The top portion comprises a dielectric substrate or carrier 109', on which a conductive layer 104', 105' is applied. The layer is divided into two separate portions 104', 105' by the slit 21'. The top portion 109', 104', 105' is preferably made as a PCB (printed circuit board) with suitable manufacturing methods.

At the two edges of the top portion, parallel with the slit, the conductive portions 104', 105' of the top portion are connected to the bottom portion 110'. The bottom portion 110' is therefore provided with conductive pins or protrusions which pass through holes in the substrate or carrier 109' and the conductive layers 104', 105'. The pins or protrusions are connected, conductively and mechanically to the conductive layer, e.g. by soldering at spots 108'.

The conductive and mechanical connections between the top and bottom portions can be obtained by other methods. For example the bottom portion can be provided with grooves e.g. by providing ridges. The top portion is then pushed into position guided by the grooves. The top portion can be retained in position by means of friction or other suitable means as soldering, gluing or mechanical fastening devices. The conductive connection is preferably obtained by the same means as the retaining function.

The radiating structure 1' is fed by a feeding or transmission line 3', e.g. by a coaxial cable as shown in the figure. The feeding line can however be of any other suitable kind, e.g. a part of a pattern of a printed circuit board or a pattern on the substrate 109', e.g. on the side opposite to that of the conductive layer 104', 105'. When a part of the feeding line 3' is located inside the radiating structure 1', it is advantageous that conductive pins or conductors extend through holes in the substrate or carrier 109' and the conductive layers 104', 105'. The pins or conductors are connected to the conductive layer, e.g. by soldering at spots 106', 107'. The ground conductor of the feed line 3' is connected to the portion 105' close to the edge 12' and close to the edge 13'. The signal conductor (hot wire) of the feed line 3' is connected to the portion 104' on the other side of the slit 21' close to the edge 11' and close to the edge 13'. Even if it is preferred that the feed line is connected at the edge 13' or close thereto, it can be connected at a distance therefrom, e.g. up to about 20 mm (for radio telephone communication bands) . The feeding line 3' can for example enter into the radiating structure 1' through a hole in a wall portion of the structure 10', as shown, or enter from an open side of the structure. It can of course enter the radiating structure 1' from the opposite side to the shown, and then the hot wire is to be connected to the portion 105', and ground is connected to portion 104', or in the vicinity thereof, as mentioned above.

In the figures, the conductive layer 104', 105' is provided on one side of the substrate or carrier 109'. However, both sides of the substrate or carrier 109' can carry the conductive layer 104', 105'. For example, the portion 104' can be provided on one side and portion 105' on the other side of the substrate or carrier 109'.

Otherwise, the function, ways of operation, and possibilities of this variation of the antenna means are similar to those of the embodiments described above, with one important exception. The capacitances formed by folded down portions in the slit region are not present here. Instead, the impedances are adjusted/matched by the width and the length of the slit 21' and "channels" or slits 111', 112' formed in the conductive layer 104', 105'. The channel/slit 112 is an example on adjusting the impedance/matching in the higher frequency band ($f_{c2}$).

Figure 25:
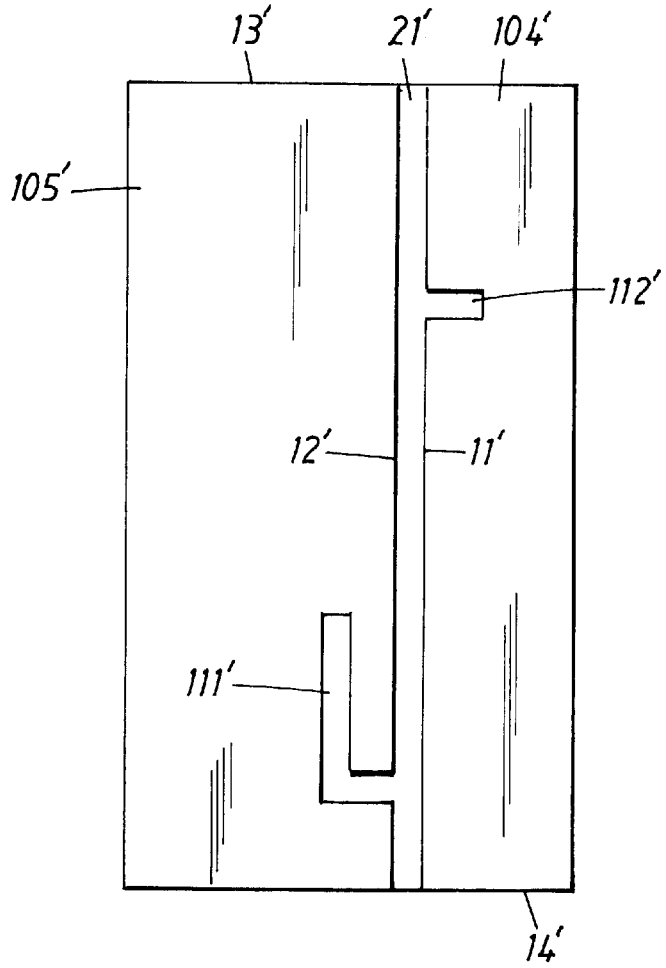
FIG. 25 is a top view of a variation of the conductive layer, carried by a substrate or carrier in the antenna means of FIG. 22.

FIG. 25 is a top view of a variation of the conductive layer 104', 105', carried by the substrate or carrier 109' in the antenna means of FIG. 22. Here, channel 111', which is formed in portion 105' and connected to slit 21', forms an impedance as mentioned above. Channel 112' is provided in order to further improve the higher frequency band ($f_{c2}$).

Figure 26:
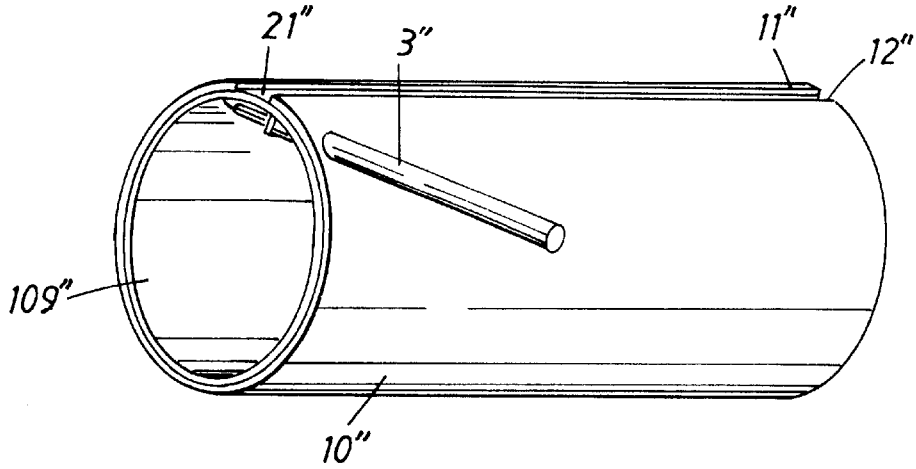
FIG. 26 is a view of a further variation of an antenna means according to the invention, where a conductive layer, carried by a substrate or carrier, is included in the conductive or radiating structure.

FIG. 26 is a view of a further variation of an antenna means according to the invention, where a conductive layer, carried by a substrate or carrier, is included in the conductive or radiating structure. The substrate or carrier 109" is tubular and can be a flexible substrate. The conductive structure 10" is arranged on the tubular substrate or carrier 109" so as to exhibit slit 21". Further, the conductive structure do not have to be continuous, as long as there is an electrical connection between edges 12" and 11". Furthermore the conductive structure 10" can be provided with a dielectric cover or insulation. The function, ways of operation, and possibilities of this variation of the antenna means are similar to those of the previous described variation.

In all embodiments the matching can be done directly in the radiating structure 1. This is done by adjusting the size of the slit (length and width), the size of the radiating structure 1, and/or the capacitance over the slit. The capacitance can be adjusted and adapted to the different frequency bands by different shapings of the sections 15, 16, whereof some examples, which can be used in the previous embodiments, are shown in FIGS. 15 and 16. In FIG. 15 it is shown how the widths of the sections 15, 16 varies stepwise, and in FIG. 16 it is shown how the widths of the sections 15, 16 varies continuously. In connection to the matching, the slit can be short-circuited by means of a conductive tape, plate or other conductor 23 arranged at the end of the slit, which is opposite to the end which is close to the feed portion. This is illustrated in FIG. 21. By this arrangement the antenna means can be tuned to e.g. $\lambda/4$. Such an antenna means will be longer and operable in narrower frequency band(s).

Also the slit can have other forms than the parallel shape and perpendicular extension over the conductive structure. FIG. 17 and 18 show the radiating structure 1 with examples of different shapes of the slit(s), which can be used in the previous embodiments. FIG. 17 shows a slit having a curved shape and FIG. 18 shows a slit having a distance between the edges 11, 12, which varies along the slit.

Figure 19A:
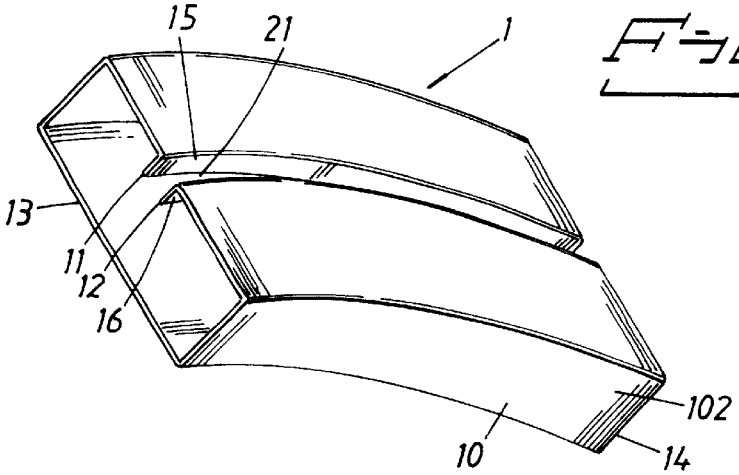
FIGS. 19*a* and 19*b* show the radiating structure with curved shape.
Figure 19B:
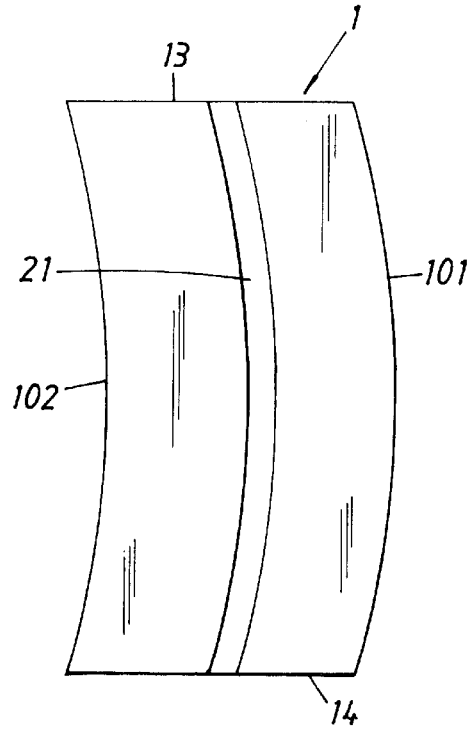

The radiating structure 1 can further be given a curved shape. In FIGS. 19*a* and 19*b* a radiating structure 1 having a such shape is shown. In this embodiment the first 101 and second 102 wall sections are parallel and parallel to the slit, which is preferable but not necessary. In the antenna means of this embodiment of the invention the radiating structure 1 can further be provided with two slits and/or be provided with a dielectric plate, as in previous embodiments. The curved shape has the advantage that a greater freedom in locating the antenna means with preserved antenna performance is obtained.

Figure 20:
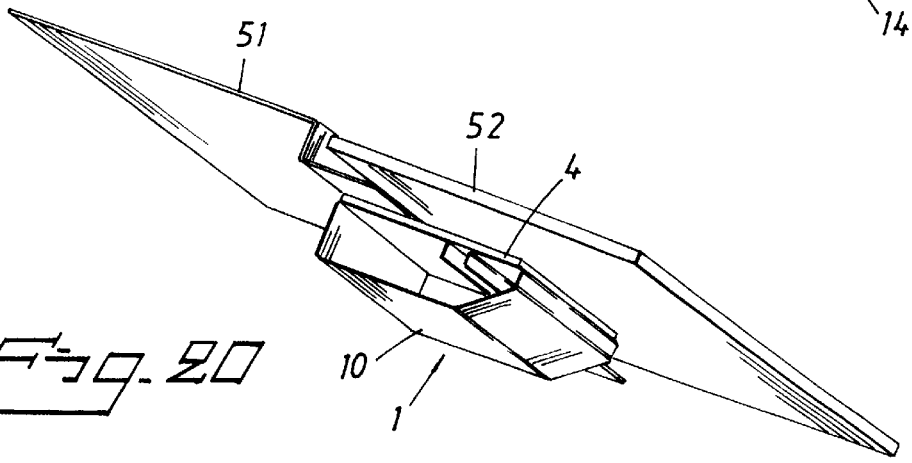
FIG. 20 is a diagrammatic view of an antenna means according to invention mounted to a glass pane of an automobile.

The mounting in a vehicle of an antenna device according to the invention is schematically shown in FIG. 20, where 51 is a conductive part of the vehicle, e.g. the roof, and 52 is a glass pane, e.g. the wind shield. The radiating structure 1 is located so that slit 21 and slit 22, if present, are covered by the glass pane, preferably with a non-metallized portion thereof If the antenna means 1 is provided with a dielectric plate, the dielectric material is preferably selected to have a dielectric constant different from that of the glass pane, the electromagnetic waves transmitted/received by the antenna means can then be refracted and the antenna lobe can hereby be controlled. When the dielectric constant of the dielectric plate 4 is lower (e.g. $\epsilon_r \approx 2.5$) than dielectric constant of the glass pane (e.g. $\epsilon_r \approx 4$–5) the radiation lobe will be directed more downwards or to a more horizontal direction. As mentioned, the antenna means 1 does not require a special ground plane, and the reason is the closed structure. It can further be mounted to have very low sensitivity to adjacent conductive parts If the radiating structure 1 is looked at without the conductive part 51 in FIG. 20, the electric fields passes the slit and has circular forms in a plane perpendicular to the slit (in fact two circular formations in each direction from the slit). If a conductive plate is introduced in the field and essentially forms a radius or a portion thereof to the circular field lines, the field lines will be incident essentially perpendicular to the plate, which leads to a very low influence from the conductive plate. In the case of FIG. 20 the conductive part 51 is present. Then it is essential that there is no galvanic or conductive connection between the radiating structure 1 and the conductive part 51. When the dielectric plate 4 is present there will be a sufficient insulation therebetween. Alternatively or in combination an inner lining, edging or similar, made of plastic, rubber or some other dielectric material can be used as insulation. A capacitive coupling will then appear between the radiating structure 1 and the conductive part 51, which can be calculated or measured and compensated for if desired.

The antenna means is preferably protected, when mounted, by a cover or housing of plastic or an other suitable dielectric material. Possibly the antenna means is attached to a housing which is mounted on the vehicle.

The antenna means is mounted by means of snapping means, screwing, gluing or other suitable method. It should preferably be mounted with a small spacing (or none) from the glass pane, e.g. about 0–10. Of course other locations on a vehicle then the shown and described are possible and suitable. It is then favorable if the slit is not covered by any conductive material.

Some of the radiating structures 1 or portions thereof described above are suitable to be manufactured by extrusion and subsequent cutting into suitable lengths. Alternatively stamping or cutting from a plate, and subsequent bending operations can be used. Thus, a profile according to some of the embodiments above can be manufactured from one conductive plate.

Although the invention is described by means of the above examples, naturally, many variations are possible within the scope of the invention. For example, the embodiments with their dimensions and measures have been described for radio telephone communication bands, but for operation in other frequency bands the dimensions and measures should be adjusted.

What is claimed is:

1. An antenna means for transmitting and/or receiving RF signals, comprising: a conductive structure extending between first and second opposite edges, and a feed portion, the conductive structure is a radiating structure partially enclosing a volume, and the first and second edges are located at a first distance from each other forming an open radiating first slit, having at least one open end, the conductive structure having a second slit at a second distance from the first slit, and the second slit having at least one portion essentially parallel with the first slit, the second slit having a first and second end, whereof the first end is open and the second end is closed.

2. The antenna means according to claim 1, wherein the conductive structure comprises a conductive plate extending between the first and second edges.

3. The antenna means according to claim 1, wherein said slit has first and second open ends.

4. The antenna means according to claim 1, wherein the conductive structure further has third and fourth opposite edges, and the first slit extends between the third and fourth edges.

5. The antenna means according to claim 1, wherein additional capacitance means is provided between the first and second edges.

6. The antenna means according to claim 5, wherein the capacitance is formed by a first section and a second section of the conductive structure in connection with the first and second edges, respectively, and the first and second sections are arranged to be essential parallel.

7. The antenna means according to claim 1, wherein the radiating structure has a shape being box-like.

8. The antenna means according to claim 1, wherein the conductive structure extends in one plane in regions surrounding at least one said slit.

9. The antenna means according to claim 1, wherein the radiating structure has a circumference being essentially in the range $\lambda/2$–$\lambda/4$, and a length being essentially in the range $\lambda/2$–$\lambda/3$, in a direction perpendicular to said circumference, where X is the wavelength, of a signal of the center frequency of a frequency band, being the lower frequency band in which the antenna means is to be operating.

10. The antenna means according to claim 1, wherein the radiating structure has a circumference being essentially $\lambda/2$, and a length being essentially $\lambda/2$, in a direction perpendicular to said circumference, where $\lambda$ is the wavelength, of a signal of the center frequency of a frequency band, being the lower frequency band in which the antenna means is to be operating.

11. The antenna means according to claim 1, wherein a first dielectric material is arranged to cover at least one said slit.

12. The antenna means according to claim 11, wherein said antenna means is adapted to be mounted on one side of a window having a dielectric constant different to that of the first dielectric material.

13. The antenna means according to claim 12, wherein the dielectric constant of the first dielectric material is lower than the dielectric constant of the glass pane.

14. The antenna means according to claim 11, wherein the antenna means is adapted to be mounted on a vehicle, on one side of a glass pane having a dielectric constant different to that of the first dielectric material.

15. The antenna means according to claim 1, wherein a first dielectric material is arranged to cover at least one said slit and regions around at least one said slit.

16. The antenna means according to claim 1, wherein the antenna means is adapted to be mounted on a vehicle, on one side of a glass pane, possibly close to a conductive part of the vehicle.

17. The antenna means according to claim 1, wherein said first distance is constant along the slit.

18. The antenna means according to claim 1, wherein said first distance increases linearly along the slit.

19. The antenna means according to claim 1, wherein at least one channel in the conductive layer is connected to at least one slit forming an impedance in the conductive layer.

20. A radio communication system comprising transmitting/receiving circuits connected to an antenna means, includes an antenna means according to claim 1.

21. The radio communication system according to claim 20, wherein said transmitting/receiving circuits operate in two or more frequency bands.

22. A method for manufacturing a radiating structure of an antenna means according to claim 1, wherein at least a portion of the radiating structure is extruded.

23. An antenna means for transmitting and/or receiving RF signals, comprising: a conductive structure extending between first and second opposite edges, and a feed portion, the conductive structure is a radiating structure partially enclosing a volume, and the first and second edges are located at a first distance from each other forming an open radiating first slit, having at least one open end, the conductive structure having a second slit at a second distance from the first slit, and the second slit having at least one portion essentially parallel with the first slit, the second slit having two opposite sides between which a capacitance is arranged.

24. An antenna means for transmitting and/or receiving RF signals, comprising: a conductive structure extending between first and second opposite edges, and a feed portion, the conductive structure is a radiating structure partially enclosing a volume, and the first and second edges are located at a first distance from each other forming an open radiating first slit, having at least one open end, the radiating structure including a conductive layer carried by a dielectric substrate in which layer said first slit is arranged, thereby forming two portions of the conductive layer.

25. An antenna means for transmitting and/or receiving RF signals, comprising: a conductive structure extending between first and second opposite edges, and a feed portion, the conductive structure is a radiating structure partially enclosing a volume, and the first and second edges are located at a first distance from each other forming an open radiating first slit, having at least one open end, conductive portions being arranged on opposite surfaces of a dielectric substrate and where said slit being formed between adjacent edges on opposite surfaces of said conductive portions.

26. The antenna means according to claim 25, wherein a first conductive portion on a first side of said dielectric substrate is at least partly overlapping a second conductive portion on a second side of said dielectric substrate.

27. The antenna meas according to claim 25, wherein a first conductive portion on a first side of said dielectric substrate is laterally displaced from a second conductive portion on a second side of said dielectric substrate, thereby, forming parts of said opposite surfaces arranged on top of each other including no conductive material.

28. An antenna means for transmitting and/or receiving RF signals, comprising: a conductive structure extending between first and second opposite edges, and a feed portion, the conductive structure is a radiating structure partially enclosing a volume, and the first and second edges are located at a first distance from each other forming an open radiating first slit, having at least one open end, the radiating structure including a conductive layer carried by a dielectric substrate in which said layer, said first slit and a second slit are arranged.

29. An antenna means for transmitting and/or receiving RF signals, comprising: a conductive structure extending between first and second opposite edges, and a feed portion, the conductive structure is a radiating structure partially enclosing a volume, and the first and second edges are located at a first distance from each other forming an open radiating first slit, having at least one open end, at least two channels in the conductive layer being connected to at least one slit whereof a first channel being adapted for matching/tuning the antenna means for-a higher frequency band and whereof a second channel being adapted for matching/tuning the antenna means for a lower frequency band.

30. An antenna means for transmitting and/or receiving RF signals, comprising: a conductive structure extending between first and second opposite edges, and a feed portion, the conductive structure is a radiating structure partially enclosing a volume, and the first and second edges are located at a first distance from each other forming an open radiating first slit, having at least one open end, the radiating structure being divided into at least two constructional portions, a first portion including said dielectric substrate carrying at least one said conductive layer and exhibiting fifth and sixth edges, said first slit being located between the fifth and sixth edges, and a second portion exhibiting seventh and eighth edges, being conductively connected to the fifth and sixth edges, respectively.

* * * * *